US008684703B2

(12) United States Patent
Ikeda et al.

(10) Patent No.: US 8,684,703 B2
(45) Date of Patent: Apr. 1, 2014

(54) RECIPROCATING COMPRESSOR

(75) Inventors: Hiroshi Ikeda, Isesaki (JP); Tsutomu Ishikawa, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 582 days.

(21) Appl. No.: 12/935,245

(22) PCT Filed: Mar. 11, 2009

(86) PCT No.: PCT/JP2009/054650
§ 371 (c)(1),
(2), (4) Date: Sep. 28, 2010

(87) PCT Pub. No.: WO2009/119316
PCT Pub. Date: Oct. 1, 2009

(65) Prior Publication Data

US 2011/0020158 A1 Jan. 27, 2011

(30) Foreign Application Priority Data

Mar. 28, 2008 (JP) ..... 2008-087337

(51) Int. Cl.

| | |
|---|---|
| ***F04B 1/12*** | (2006.01) |
| ***F04B 27/08*** | (2006.01) |
| ***F04B 39/10*** | (2006.01) |
| ***F04B 53/10*** | (2006.01) |
| ***F16K 15/00*** | (2006.01) |
| ***F16K 17/00*** | (2006.01) |
| ***F16K 21/04*** | (2006.01) |

(52) U.S. Cl.
USPC ..... 417/269; 417/560; 137/512.4

(58) Field of Classification Search
USPC ..... 417/222.2, 269, 270, 531, 532, 538, 417/539, 559, 560; 137/512.15, 512.4
See application file for complete search history.

(56) References Cited

U.S. PATENT DOCUMENTS 5,044,892 A 9/1991 Pettitt
5,613,836 A 3/1997 Takenaka et al.
(Continued)

FOREIGN PATENT DOCUMENTS

DE 19610437 A1 10/1996
JP H05-089876 U 12/1993
(Continued)

OTHER PUBLICATIONS

European Patent Office, extended European Search Report for European Patent Application No. 09724940.3 (counterpart to above captioned patent application), dated Apr. 27, 2011.
(Continued)

*Primary Examiner* — Devon Kramer
*Assistant Examiner* — Lilya Pekarskaya
(74) *Attorney, Agent, or Firm* — Baker Botts L.L.P.

(57) ABSTRACT

A compressor includes a cylinder block including cylinder bores and pistons within the cylinder bores. A front housing opposes a first cylinder block end face to form a crank chamber accommodating a piston driving mechanism. A valve plate opposes a second cylinder block end face and includes suction and discharge holes. A rear housing includes suction and discharge chambers and opposes the second cylinder block end face with the valve plate there between. Strap-shaped suction valves on the valve plate end face oppose the cylinder block, thereby opening and closing the suction holes at tip portions. Discharge valves on the valve plate end face oppose the rear housing to open and close the discharge holes. Through-bolts join the front housing, the crank chamber, the cylinder block, the valve plate, and the rear housing. The valve plate includes grooves extending from holes accommodating the through-bolts to portions abutting the suction valves.

1 Claim, 5 Drawing Sheets

(56) References Cited

U.S. PATENT DOCUMENTS

| | | | | |
|---|---|---|---|---|
| 5,672,053 | A | 9/1997 | Sabha | |
| 6,022,199 | A * | 2/2000 | Yoshii et al. | 417/269 |
| 6,129,519 | A * | 10/2000 | Ogura | 417/222.2 |
| 6,378,417 | B1 * | 4/2002 | Miyazawa et al. | 92/71 |
| 6,419,467 | B1 * | 7/2002 | Murase et al. | 417/504 |
| 6,540,488 | B2 * | 4/2003 | Takai et al. | 417/222.2 |
| 7,004,734 | B2 * | 2/2006 | Izawa et al. | 417/569 |
| 7,850,437 | B2 * | 12/2010 | MacBain et al. | 417/571 |
| 7,976,288 | B2 * | 7/2011 | Inoue et al. | 417/269 |
| 2004/0076535 | A1 | 4/2004 | Izawa et al. | |
| 2006/0280617 | A1 * | 12/2006 | Uehara et al. | 417/269 |
| 2008/0286125 | A1 * | 11/2008 | Sugiura et al. | 417/269 |
| 2009/0220355 | A1 * | 9/2009 | Ogi et al. | 417/222.1 |
| 2009/0246050 | A1 * | 10/2009 | Miyaji et al. | 417/437 |

FOREIGN PATENT DOCUMENTS

| | | | |
|---|---|---|---|
| JP | H08-254183 | A | 10/1996 |
| JP | H10-196536 | A | 7/1998 |
| JP | 2001-193649 | A | 7/2001 |
| JP | 2005-105975 | A | 4/2005 |
| JP | 2007-064196 | A | 3/2007 |

OTHER PUBLICATIONS

Japan Patent Office, International Search Report for Application No. PCT/JP2009/054650, mailed Jun. 16, 2009.

Japan Patent Office, Written Opinion of the International Searching Authority for Patent Application No. PCT/JP2009/054650, mailed Jun. 16, 2009.

* cited by examiner

RECIPROCATING COMPRESSOR

CROSS-REFERENCE TO RELATED APPLICATIONS

This application is the National Stage of International Patent Application No. PCT/JP2009/054650, filed Mar. 11, 2009, which claims the benefit of Japanese Patent Application No. 2008-087337, filed Mar. 28, 2008, the disclosures of which are incorporated herein by reference in their entirety.

TECHNICAL FIELD

The present invention relates to a reciprocating compressor.

BACKGROUND ART

Patent Document No. 1 teaches a reciprocating compressor comprising a cylinder block provided with cylinder bores, pistons fitted in the cylinder bores, a front housing opposing one of the end faces of the cylinder block to cooperate with the cylinder block and thereby form a crank chamber accommodating a piston driving mechanism, a valve plate opposing the other one of the end faces of the cylinder block and provided with suction holes and discharge holes communicating with the cylinder bores, a rear housing provided with a suction chamber and a discharge chamber and opposing the other one of the end faces of the cylinder block with the valve plate inserted between them, strap-shaped suction valves fitted on the end face of the valve plate opposing the cylinder block to abut the valve plate, thereby opening and closing the suction holes at tip portions, discharge valves fitted on the end face of the valve plate opposing the rear housing to open and close the discharge holes, and through-bolts passed through the front housing, the crank chamber, the cylinder block, the valve plate and the rear housing to assemble them as a unitary body, wherein the valve plate is roughened at the portions around the suction holes to be abutted by the suction valves to decrease adhesion of lubrication oil existing between the suction valves and the valve plate, thereby preventing the adhesion of the suction valves to the valve plate to prevent delayed opening of the suction valves, enhance the performance of the compressor, and prevent self-excited vibration of the suction valves.

Patent Document No. 1: Japanese Patent Laid-Open Publication No. 2007-064196

DISCLOSURE OF INVENTION

Problem to be Solved

The technology of the Patent Document No. 1 is aimed at decreasing adhesion of lubrication oil existing between the suction valves and the valve plate, thereby decreasing the resistance force against the opening of the suction valves.

The present invention takes a different viewpoint from that of the conventional technology in that delayed opening of the suction valves is prevented by decreasing the resistance force against the opening of the suction valves. An object of the present invention is to provide a technology for increasing force for promoting the opening of the suction valves to prevent delayed opening of suction valves.

Means for Achieving the Object

In accordance with the present invention, there is provided a reciprocating compressor comprising a cylinder block provided with cylinder bores, pistons fitted in the cylinder bores, a front housing opposing one of the end faces of the cylinder block to cooperate with the cylinder block and thereby form a crank chamber accommodating a piston driving mechanism, a valve plate opposing the other one of the end faces of the cylinder block and provided with suction holes and discharge holes communicating with the cylinder bores, a rear housing provided with a suction chamber and a discharge chamber and opposing the other one of the end faces of the cylinder block with the valve plate inserted between them, strap-shaped suction valves fitted on the end face of the valve plate opposing the cylinder block to abut the valve plate, thereby opening and closing the suction holes at tip portions, discharge valves fitted on the end face of the valve plate opposing the rear housing to open and close the discharge holes, and through-bolts passed through the front housing, the crank chamber, the cylinder block, the valve plate and the rear housing to assemble them as a unitary body, wherein the valve plate is provided with grooves extending from holes for accommodating the through-bolts to portions abutting the suction valves on the end face opposing the cylinder block.

In the reciprocating compressor in accordance with the present invention, crank chamber pressure is applied to the surfaces of the suction valves abutting the valve plate through holes for accommodating the through-bolts and the grooves formed in the valve plate to force the suction valves in the direction of opening. Thus, force for promoting the opening of the suction valves increases, delayed opening of the suction valves is prevented, the performance of the compressor is enhanced, and self-excited vibration of the suction valves is prevented.

In accordance with a preferred embodiment of the present invention, the grooves extend beyond the portions opposing the roots of the suction valves to the portions near the suction holes.

When the grooves extend beyond the portions opposing the roots of the suction valves to the portions near the suction holes, the area of the suction valves receiving the crank chamber pressure increases to increase the force for promoting the opening of the suction valves.

Effect of the Invention

In accordance with the present invention, there is provided a reciprocating compressor wherein force for promoting the opening of the suction valves is increased to prevent delayed opening of suction valves.

BEST MODE FOR CARRYING OUT THE INVENTION

A reciprocating compressor in accordance with a preferred embodiment of the present invention will be described.

Preferred Embodiment No. 1

As shown in FIG. 1, a variable displacement swash plate compressor 1 comprises a circular-column-shaped cylinder block 2 provided with a plurality of cylinder bores 2*a*, a front housing 4 given a cylindrical shape closed at one end and opposing one of the end faces of the cylinder block 2 to cooperate with the cylinder block 2 and thereby form a crank chamber 3, a rotation shaft 5 disposed in the crank chamber 3, rotatably supported by the cylinder block 2 and the front housing 4, and extending out of the crank chamber 3 through the front housing 4 at one end, a rotor 6 disposed in the crank chamber 3 and fixed to the rotation shaft 5, a swash plate 8 disposed in the crank chamber 3, connected to the rotor 6 through a link member 7, engaging the rotation shaft 5 at a variable inclination, and rotated by the rotation shaft 5, pairs of shoes 9 disposed in the crank chamber 3 and slidably engaging the outer peripheral portion of the swash plate 8, pistons 10 fitted in the cylinder bores 2*a* and slidably engaging the outer peripheral portion of the swash plate 8 through the shoes 9 to reciprocate synchronously with the rotation of the swash plate 8, a circular-disk-shaped valve plate 11 provided with suction holes 11*a* and discharge holes 11*b* communicating with the cylinder bores 2*a* and opposing the other of the end faces of the cylinder block 2, a rear housing 12 given a cylindrical shape closed at one end, provided with a suction chamber 12*a* at the radial center and a discharge chamber 12*b* surrounding the suction chamber 12*a* at radial periphery, and opposing the other one of the end faces of the cylinder block 2 with the valve plate 11 inserted between them, strap-shaped suction valves 13 fitted on the end face of the valve plate 11 opposing the cylinder block 2 to abut the valve plate 11, thereby opening and closing the suction holes 11*a* at tip portions, discharge valves 14 fitted on the end face of the valve plate opposing the rear housing 12 to open and close the discharge holes 11*b*, and through-bolts 15 passed through the front housing 4, the crank chamber 3, the cylinder block 2, the valve plate 11 and the rear housing 12 to assemble them as a unitary body.

The rotation shaft 5, the rotor 6, the link member 7, the swash plate 8 and the shoes 9 constitute a piston driving mechanism.

The cylinder bores 2*a*, the pistons 10, the suction holes 11*a*, the discharge holes 11*b*, the suction valves 13, the discharge valves 14 and pairs of shoes 9 are distanced from each other in the circumferential direction.

The suction chamber 12*a* communicates with the evaporator of a car air conditioner through a suction port 16. The discharge chamber 12*b* communicates with the condenser of the car air conditioner through a discharge port. The evaporator, the condenser, the car air conditioner and the discharge port are not shown in FIG. 1.

The rotation shaft 5 is directly connected to a car engine through a power transmission device 17 at one end protruding out of the crank chamber 3. The car engine is not shown in FIG. 1.

As shown in FIGS. 2 and 3, the suction valves 13 are made by punching U-shaped holes 18*a* through a circular thin plate 18. The circular thin plate 18 is provided with holes 18*b* for accommodating the through-bolts 15, in addition to the U-shaped holes 18*a*. The valve plate 11 cooperates with the cylinder block 2 to clamp the circular thin plate 18, thereby making the circular thin plate 18 abut on the valve plate 11. Thus, the suction valves 13 are fitted on the valve plate 11. The U-shaped holes 18*a* oppose the discharge holes 11*b* formed in the valve plate 11 when the circular thin plate 18 is clamped by the valve plate 11 and the cylinder block 2 to abut on the valve plate 11.

As shown in FIGS. 2 and 3, the valve plate 11 is provided with holes 11*c* for accommodating the through-bolts 15, in addition to the suction holes 11*a* and the discharge holes 11*b*. The valve plate 11 is provided with grooves 11*d* in the end face opposing the cylinder block 2 through the circular thin plate 18. The grooves 11*d* extend from the holes 11*c* to the portions abutting the suction valves 13 without interfering with the adjacent discharge holes 11*b* or opposing the U-shaped holes 18*a* of the circular thin plate 18 abutting the valve plate 11. The grooves 11*d* extend beyond the portions opposing the roots of the suction valves 13 to the portions near the suction holes 11*a*. The grooves 11*d* communicate with the crank chamber 3 through the holes 11*c* formed in the valve plate 11 and accommodating the-through bolts, the holes 18*b* formed in the circular thin plate 18 and accommodating the through-bolts, and holes 2*b* formed in the cylinder block 2 and accommodating the through-bolts.

In the variable displacement swash plate compressor 1, the rotation shaft 5 is rotated by the car engine, the swash plate 8 rotates synchronously with the rotation of the rotation shaft 5, and the pistons 10 reciprocally move. Synchronously with the reciprocal movement of the pistons 10, coolant gas returns to the compressor from the evaporator of the car air conditioner, flows into the cylinder bores 2*a* through the suction port 16, the suction chamber 12*a*, the suction holes 11*a* and the suction valves 13, becomes compressed in the cylinder bores 2*a*, and flows out of the compressor 1 to the condenser of the car air conditioner through the discharge holes 11*b*, the discharge valves 14, the discharge chamber 12*b* and the discharge port.

In the variable displacement swash plate compressor 1, crank chamber pressure is applied on the surfaces of the suction valves 13 abutting the valve plate 11 through the holes 2*b* formed in the cylinder block 2 and accommodating the through-bolts, holes 18*b* formed in the circular thin plate 18 and accommodating the through-bolts, holes 11*c* formed in the valve plate 11 and accommodating the through-bolts, and pressure induction passages formed by the grooves 11*d* formed in the end face of the valve plate 11 opposing the cylinder block 2 and the circular thin plate 18 abutting the valve plate 11. The crank chamber pressure applied on the suction valves 13 forces the suction valves 13 in the opening direction. In the conventional reciprocating compressor, only the forces due to the differential pressure between the suction chamber pressure and the cylinder bore pressure applied on the portions of the suction valves 13 opposing the suction holes 11*a* operate on the suction valves 13 to push them open. In the variable displacement swash plate compressor 1, in addition to the forces due to the aforementioned differential pressure, forces due to the differential pressure between the crank chamber pressure and the cylinder bore pressure applied on the portions of the suction valves 13 opposing the grooves 11*d* are also applied on the suction valves 13 to push the suction valves 13 open. Thus, force for promoting the opening of the suction valves becomes larger than that in the conventional reciprocating compressor, delayed opening of the suction valves 13 is prevented, the performance of the compressor is enhanced, and the self-excited vibration of the suction valves 13 is prevented.

When the grooves 11*d* extend beyond the portions opposing the roots of the suction valves 13 to the portions near the suction holes 11*a*, the area of the portions of the suction valves 13 receiving the crank chamber pressure increases to increase the forces for pushing the suction valves 13 open.

When the discharge chamber 12*b* is disposed at the radial center and the suction chamber 12*a* is disposed at radial periphery to surround the discharge chamber 12*b*, it is possible, as shown in FIGS. 4 and 5, to form on the end face of the valve plate 11 opposing the cylinder block 2 through the circular thin plate 18 grooves 11*d* extending from the holes 11*c* accommodating the through-bolts to the portions abutting the suction valves 13 without interfering with the discharge holes 11*b* and make the grooves 11*d* extend beyond the portions opposing the roots of the suction valves 13 to the portions near the suction holes 11*a*, thereby applying the crank chamber pressure on the surfaces of the suction valves 13 abutting the valve plate 11 through the holes 2*b* formed in the cylinder block 2 and accommodating the through-bolts, holes 18*b* formed in the circular thin plate 18 and accommodating the through-bolts, holes 11*c* formed in the valve plate

11 and accommodating the through bolts, and the grooves 11*d* formed in the end face of the valve plate 11 opposing the cylinder block 2. The pressure forces the suction valves 13 in the opening direction. Thus, the forces for pushing the suction valves 13 open become larger than that by the conventional technology, the delayed opening of the suction valves 13 is prevented more effectively than by the conventional technology, and the self-excited vibration of the suction valves is prevented more effectively than by the conventional technology.

INDUSTRIAL APPLICABILITY

The present invention can be widely used in various kinds of reciprocating compressors including swash plate compressors, wobble plate compressors, etc.

BRIEF DESCRIPTION OF THE REFERENCE NUMERALS

Figure 1:
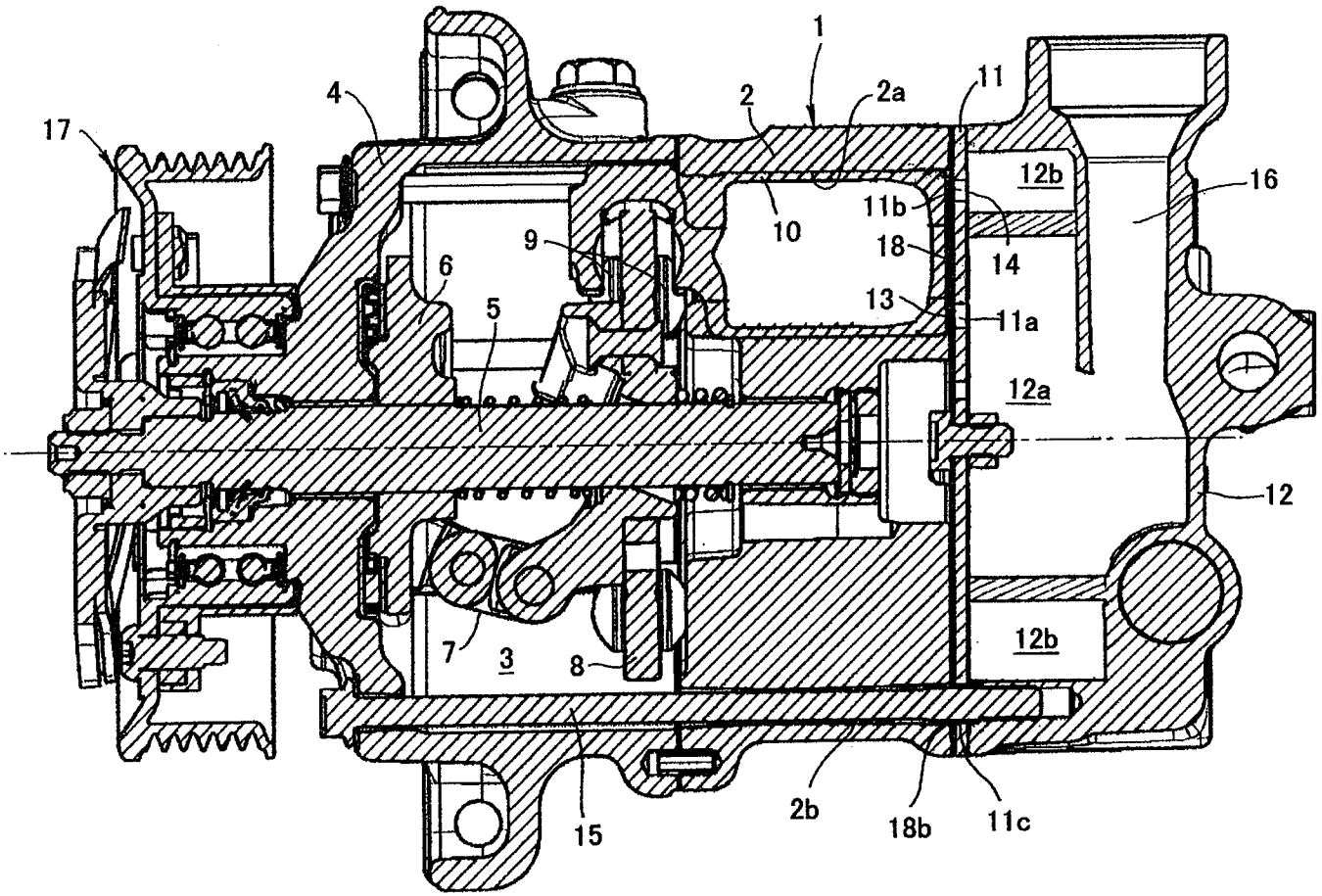
FIG. 1 is a sectional view of a variable displacement swash plate compressor in accordance with a preferred embodiment of the present invention.
Figure 2:
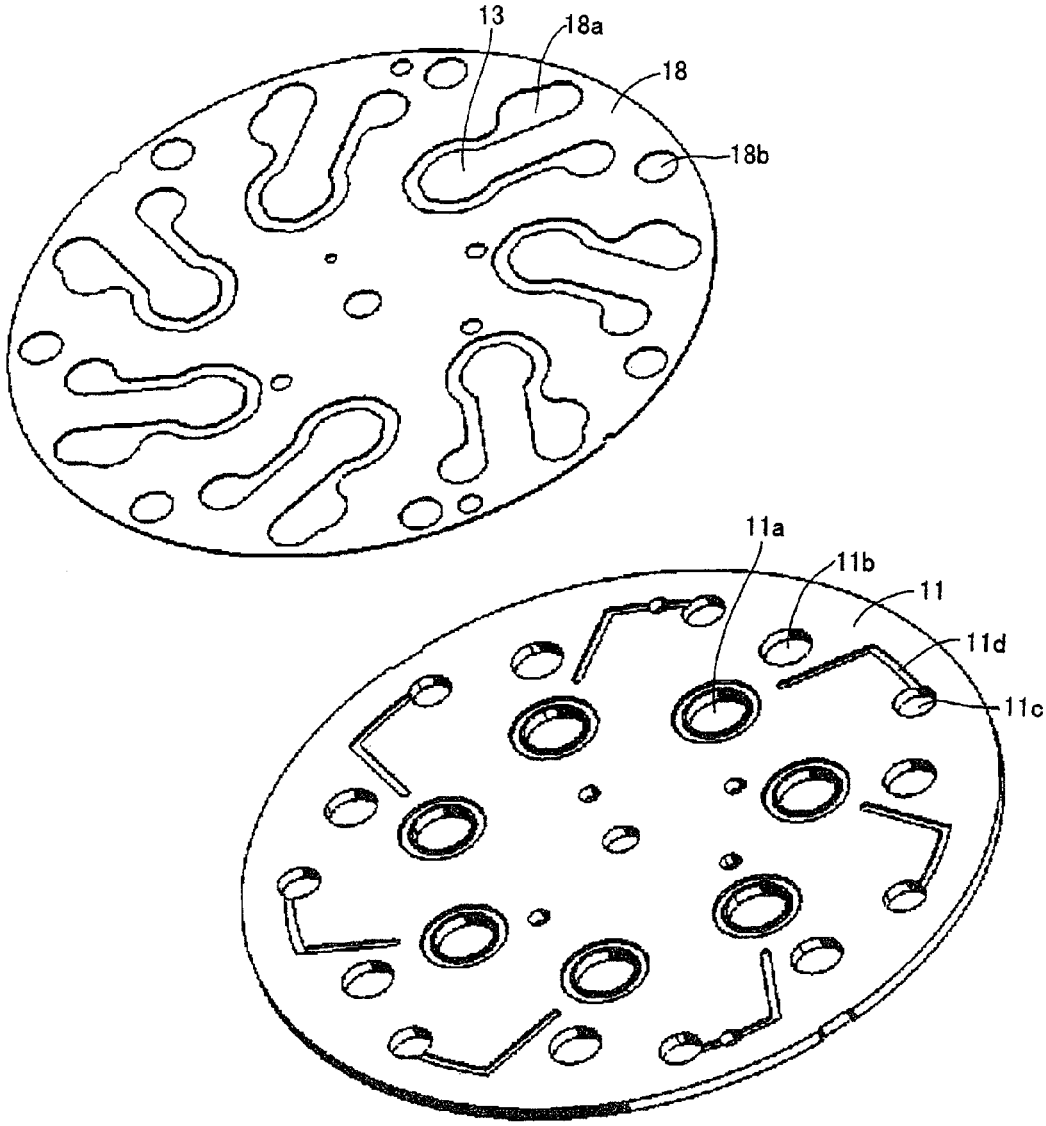
FIG. 2 is a set of perspective views of the suction valves and the valve plate provided for the variable displacement swash plate compressor in accordance with a preferred embodiment of the present invention.
Figure 3:
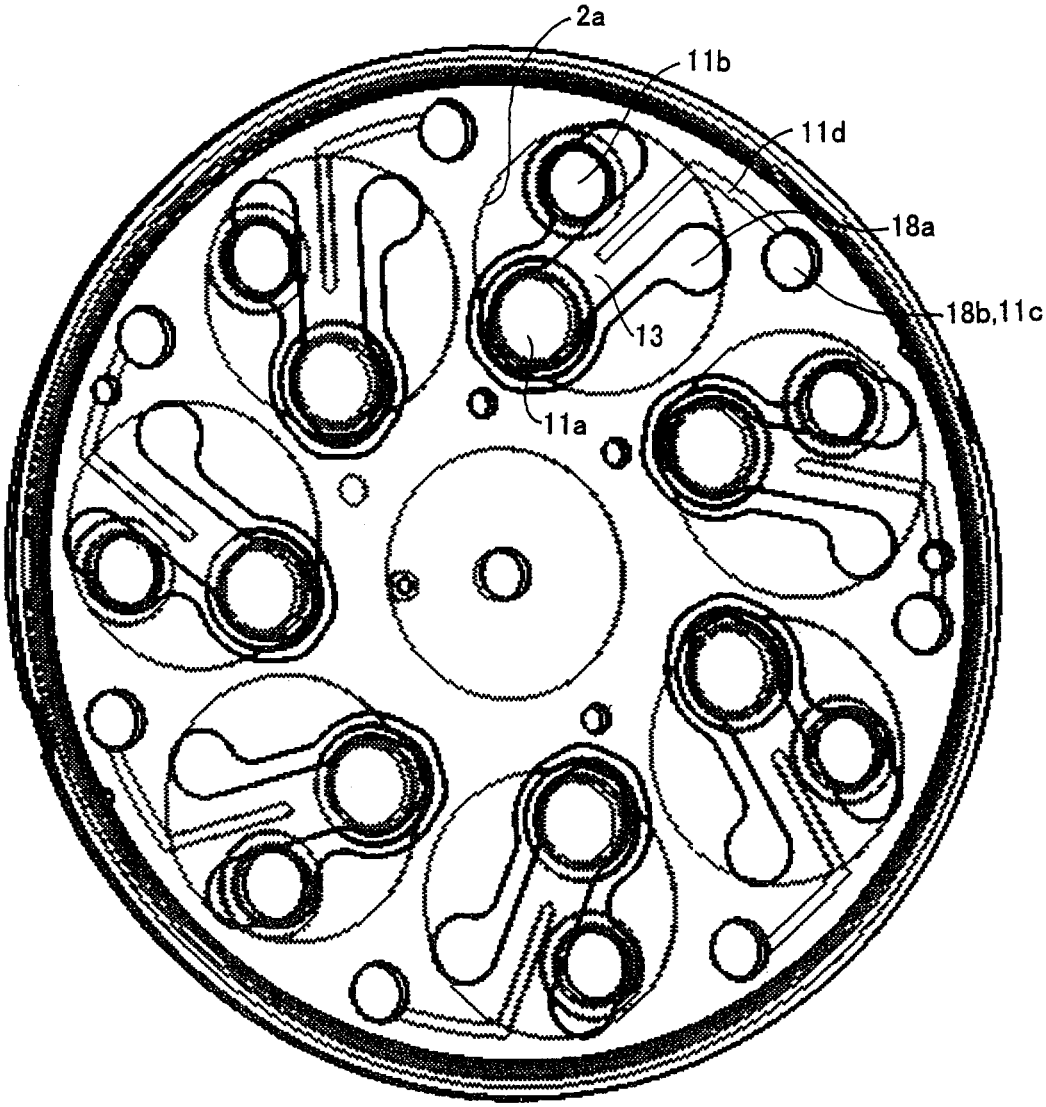
FIG. 3 is a set of perspective views of the suction valves and the valve plate of FIG. 2 wherein the suction valves are fitted on the valve plate.
Figure 4:
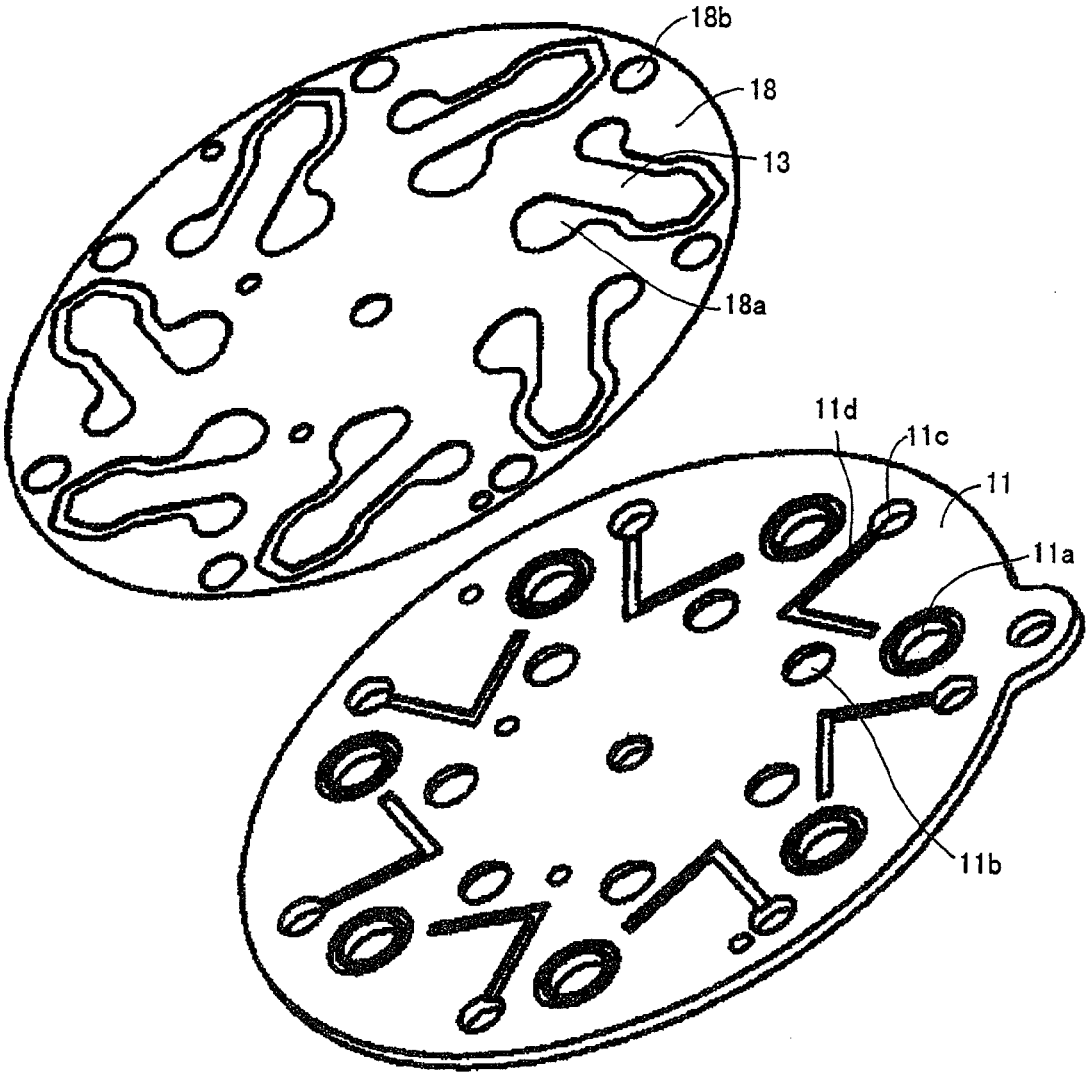
FIG. 4 is a set of perspective views of the suction valves and the valve plate provided for the variable displacement swash plate compressor in accordance with another preferred embodiment of the present invention.
Figure 5:
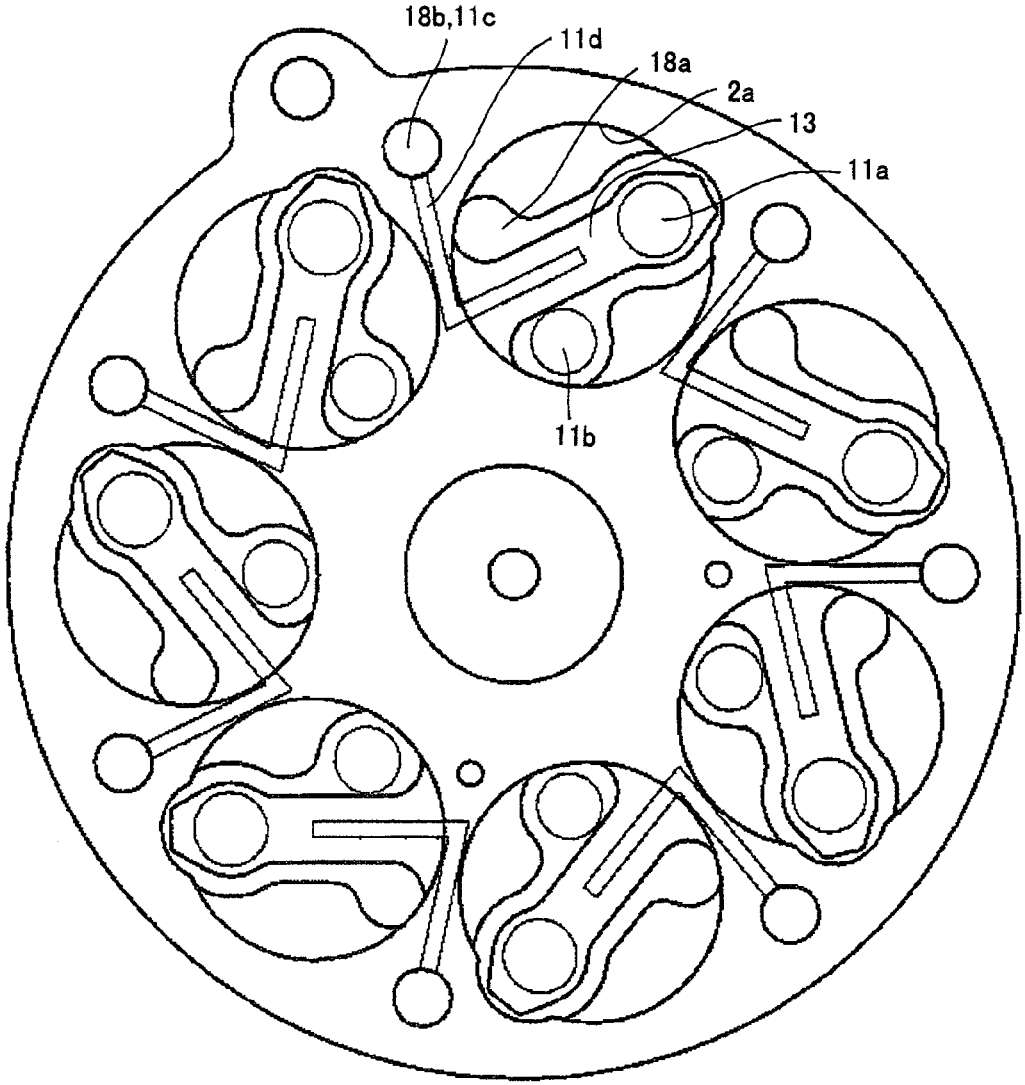
FIG. 5 is a set of perspective views of the suction valves and the valve plate of FIG. 4 wherein the suction valves are fitted on the valve plate.

1 Variable displacement swash plate compressor
2 Cylinder block
2*a* Cylinder bore
2*b* Hole for accommodating through-bolt
3 Crank chamber
4 Front housing
5 Rotation shaft
6 Rotor
7 Link member
8 Swash plate
9 Pair of shoes
10 Piston
11 Valve plate
11*a* Suction hole
11*b* Discharge hole
11*c* Hole for accommodating through-bolt
11*d* Groove
12 Rear housing
12*a* Suction chamber
12*b* Discharge chamber
13 Suction valve
14 Discharge valve
15 Through-bolt
16 Suction port
17 Power transmission device
18 Circular thin plate
18*a* U-shaped hole
18*b* Hole

The invention claimed is:

1. A reciprocating compressor comprising:

a cylinder block provided with cylinder bores, pistons fitted in the cylinder bores, a front housing opposing one of the end faces of the cylinder block to cooperate with the cylinder block and thereby form a crank chamber accommodating a piston driving mechanism, a valve plate opposing the other one of the end faces of the cylinder block and provided with suction holes and discharge holes communicating with the cylinder bores, a rear housing provided with a suction chamber and a discharge chamber and opposing the other one of the end faces of the cylinder block with the valve plate inserted between them, strap-shaped suction valves fitted on the end face of the valve plate opposing the cylinder block to abut the valve plate, thereby opening and closing the suction holes at tip portions, discharge valves fitted on the end face of the valve plate opposing the rear housing to open and close the discharge holes, and through-bolts passed through the front housing, the crank chamber, the cylinder block, the valve plate and the rear housing to assemble them as a unitary body, wherein the valve plate is provided with grooves extending from holes for accommodating the through-bolts to portions abutting the suction valves in the end face opposing the cylinder block, wherein the grooves extend beyond particular portions of the valve plate, which are in face to face opposition to base portions of the suction valves, to other portions of the valve plate near the suction holes, and wherein the base portions of the suction valves are disposed at ends of the suction valves opposite to the tip portions of the suction valves.

* * * * *